US008579100B1

(12) United States Patent
Parisi et al.

(10) Patent No.: US 8,579,100 B1
(45) Date of Patent: Nov. 12, 2013

(54) RETRO-FIT METHOD FOR IMPROVING COIN-OPERATED VENDING MACHINES

(75) Inventors: Frank Parisi, Larchmont, NY (US); James Henry Hinton, Los Angeles, CA (US)

(73) Assignees: Parsal Vending Supply, LLC, Oceanside, NY (US); Oak Manufacturing Company, Inc., Vernon, CA (US)

( * ) Notice: Subject to any disclaimer, the term of this patent is extended or adjusted under 35 U.S.C. 154(b) by 0 days.

(21) Appl. No.: 13/461,882

(22) Filed: May 2, 2012

(51) Int. Cl.
*G07F 11/44* (2006.01)
*A47F 1/10* (2006.01)

(52) U.S. Cl.
USPC ..... 194/350; 312/35

(58) Field of Classification Search
USPC ..... 194/350, 352, 353; 312/35, 211, 212, 312/270.1, 249.1, 351.1, 352; 248/346.01, 248/346.02, 346.5, 694; 221/1, 174, 191, 221/197, 199, 281, 282, 283, 285, 286, 221/312 R; 453/63; 211/1, 71.01, 78, 84, 211/85.17, 126.1, 126.15, 163
See application file for complete search history.

(56) References Cited

U.S. PATENT DOCUMENTS 2,537,317 A * 1/1951 Probasco ..... 222/153.03
5,467,858 A * 11/1995 Kovens et al. ..... 194/350
8,272,492 B1 * 9/2012 Chang ..... 194/350

* cited by examiner

*Primary Examiner* — Mark Beauchaine
(74) *Attorney, Agent, or Firm* — Adam K. Sacharoff

(57) ABSTRACT

A method of retro-fitting a coin-operated vending machine includes first removing the base and coin retainer and then connecting an improved base unit to a lower end of the center rod. The improved base unit has a bottom for collecting coins and an opened section for access to the bottom. When the improved base unit is connected to the center rod, the improved base unit is movable into at least two configurations. The first configuration is defined such that the opened section is hidden within the body preventing access to the bottom, while the second configuration is defined such that at least a portion of the opened section is exposed whereby access to the bottom, and any coins, is granted through the exposed opened section.

4 Claims, 6 Drawing Sheets

RETRO-FIT METHOD FOR IMPROVING COIN-OPERATED VENDING MACHINES

FIELD OF THE INVENTION

The present invention relates to a method for retro-fitting a coin-operated vending machine to provide the owner with an easier access to the coins.

BACKGROUND OF THE INVENTION

Coin-operated vending machines, such as gum ball machines, have been popular for many years. One of the main difficulties with older coin-operated vending machines such as shown in FIG. 1, is the ability to retrieve the coins requires multiple steps and removal of multiple parts. As shown in Prior Art FIGS. 1-6, the vending machine 100 first requires the removal of the cap 110. This is often done by unscrewing with a key a lock that secures the cap 110 until a center rod 115. Once the cap 110 is removed, the center rod 115 can be partially unscrewed to release the globe 120 and hopper 125 from the bottom body 130. The bottom body 130 has secured thereto the coin mechanism 135 and the chute 140. Once the globe/hopper are removed, the use can flip the bottom body 130 over to dump the coins into a tray 10. The coins are secured in the bottom body 130, because the bottom body has a coin retainer 135 secured thereto. Lastly, the coin retainer 135 is further secured by a base 140 that is attached to the bottom body 130. In the prior art Figures the base 140 is shown separated for illustration purposes, the base 140 is typically not removed when the coins are dumped.

It is thus an objective of the invention to provide a method of retro-fitting the older coin-operated machines for new components that allow for an easier and most likely faster method for removing the coins.

SUMMARY OF THE INVENTION

In one embodiment of the present invention, there is provided a method of retro-fitting a coin-operated vending machine. The coin-operated vending machine has a cap, a globe, a hopper attached to the globe, a body aligned with the hopper, a coin retainer attached to the body, a base, and a center rod passing through the globe, hopper, body, a coin retainer. The center rod having threaded ends to secure the cap to the base. The method to retro-fit is defined in a first step removing the base and coin retainer; and in a second step connecting an improved base unit to a lower end of the center rod. The improved base unit includes a bottom for collecting coins and an opened section for access to the bottom. When the improved base unit is connected to the center rod, the improved base unit is movable into at least two configurations, a first configuration defined such that the opened section is hidden within the body preventing access to the bottom, and a second configuration defined such that at least a portion of the opened section is exposed whereby access to the bottom, and any coins, is granted through the exposed opened section. In other aspects of the invention the improved base unit may be further defined to include a lower base section having a first walled section surrounding a periphery of the lower base section; a center portion being positioned in the lower base section and having a female threaded receiving section configured to receive the lower end of the center rod; and a second walled section extending upwardly from the first walled section and being positioned inwardly from the first walled section to define a rim along a junction of the first walled section and the second walled section, wherein the opened section is positioned in the second walled section.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figures 1, 2, 3:
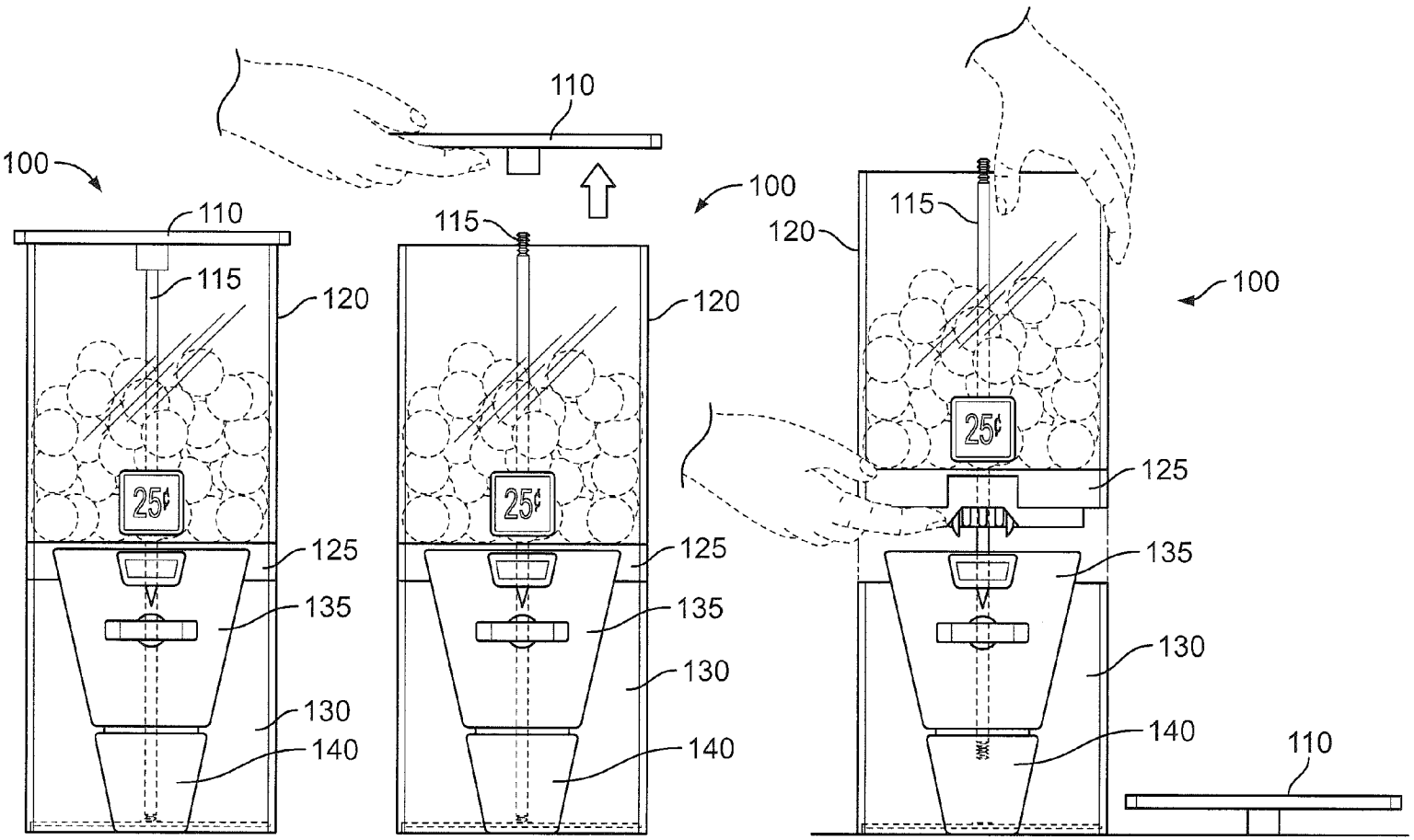
FIG. 1 (Prior Art)
FIG. 2 (Prior Art)
FIG. 3 (Prior Art)
FIG. 1 is a prior art illustration of a older type of coin-operated vending machine.
FIG. 2 is a prior art illustration of FIG. 1 with the cap being removed.
FIG. 3 is a prior art illustration of FIG. 2 with the globe and hopper being removed.
Figures 4, 5, 6:
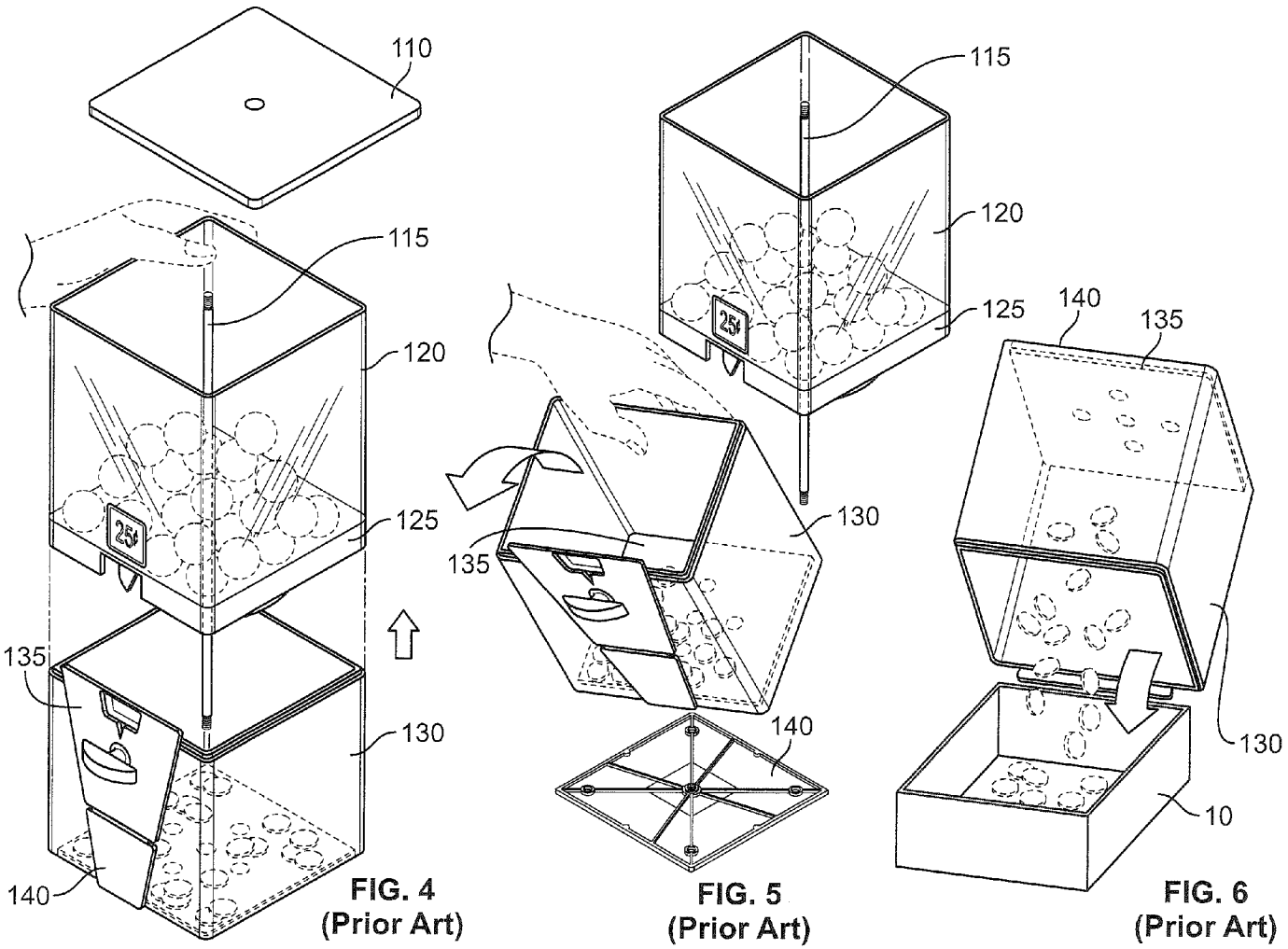
FIG. 4 (Prior Art)
FIG. 5 (Prior Art)
FIG. 6 (Prior Art)
FIG. 4 is a prior art illustration of FIG. 1 showing the cap, globe/hopper being removed from the body.
FIG. 5 is a prior art illustration of FIG. 4 showing the body being tilted to illustrated the coin retainer.
FIG. 6 is a prior art illustration showing the body being tilted until the coins are capable of being dumped from the body into a tray.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention, claims, and/or embodiments illustrated.

Figure 7:
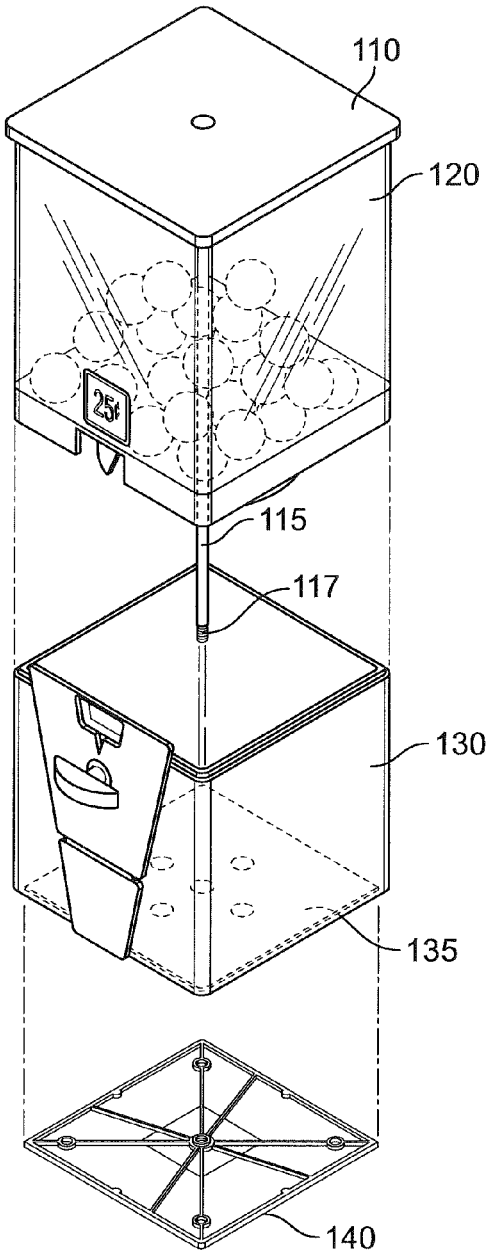
FIG. 7 is an illustration of one step used in the method of retro-fitting an older coin-operated machine with an improved base unit.
Figure 8:
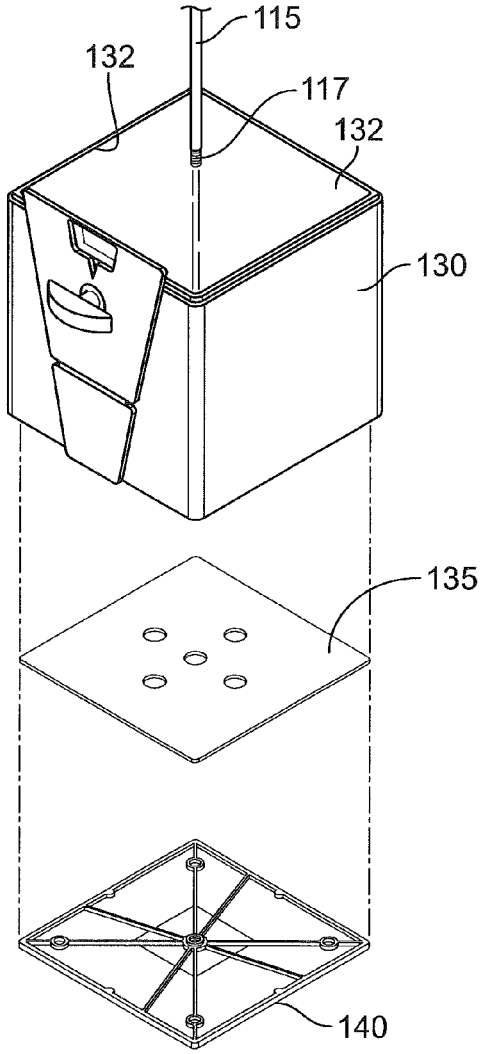
FIG. 8 is a further instructions of the method of retro-fitting.
Figure 9:
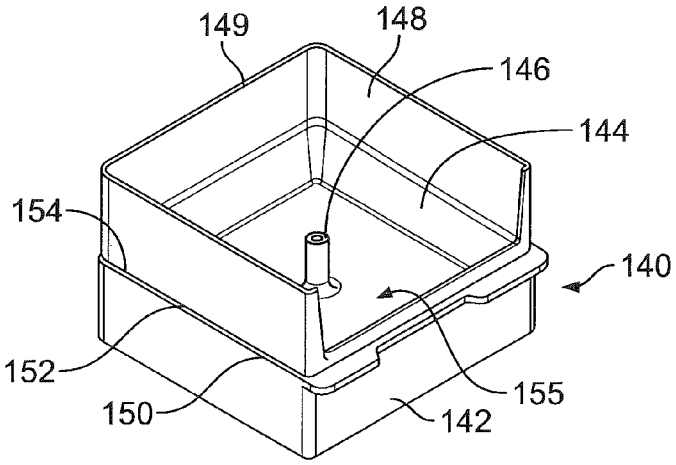
FIG. 9 is a perspective view of the improved base unit.
Figure 10:
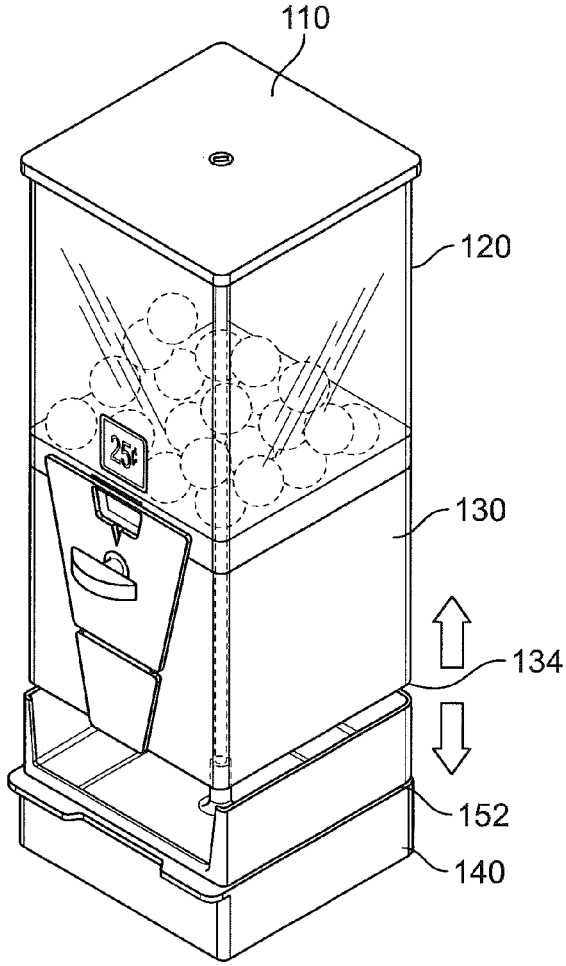
FIG. 10 is an illustration of the coin-operated machine with the improved base unit.

Referring now to FIGS. 7-10, the retro-fit of the older prior art vending machine 100 first requires the release of the lock such that the center rod 115 can release the base 140. Additional screws would also have to be removed from the corners of the base 140. Once the base 140 is removed the coin retainer 135 can be unscrewed and removed. The improved base unit 140 can then be secured to the center rod 115. Additional screws or securing means are no longer necessary with the improved base. As the improved base unit 140 simply needs to be secured into the center rod 115.

The improved base unit 140 includes a lower base section 142 that has a first walled section 144 surrounding the periphery of the lower base section. Extending from the lower base section 142 about a center portion thereof is a female threaded receiving section 146 configured to receive a threaded end 117 of the center rod 115. Extending upwardly from the first walled section 144 is a second walled section 148. The second walled section is also slightly positioned inwardly from the first walled section such that a rim 152 is created along the junction of the top portion 150 of the first walled section 144 and the bottom portion 154 of the second walled section 148. In addition, the second walled section 148 only includes three walls, leaving one portion opened 155.

When attached to the body 130, the second walled section 148 being positioned inwardly from the first walled section is configured such that the second walled section 148 is positioned within the walls 132 of the body 130. In addition, the bottom terminal edge 134 of the body 130 would rest against the rim 152 of the base unit 140. In other embodiments, the second walled section may preferably be resting against the interior sections of the walls 132.

Figure 13:
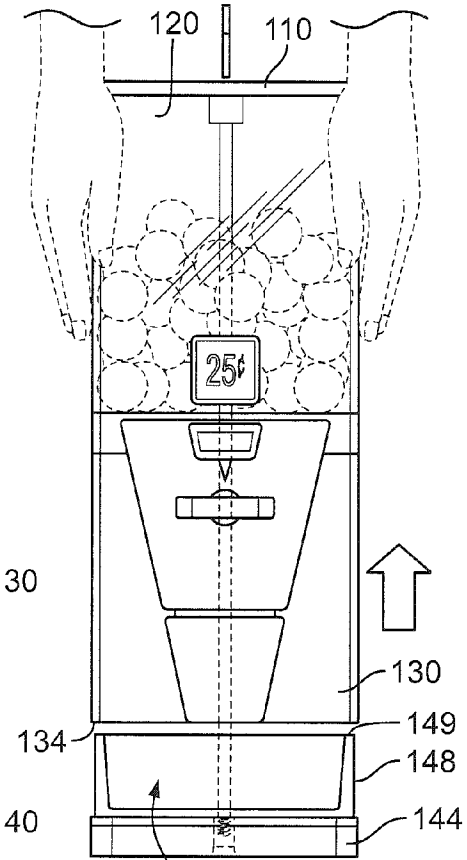
FIGS. 11-15 are illustrations of the coin-operated machine with the improved base unit and the method used to remove coins.
Figure 12:
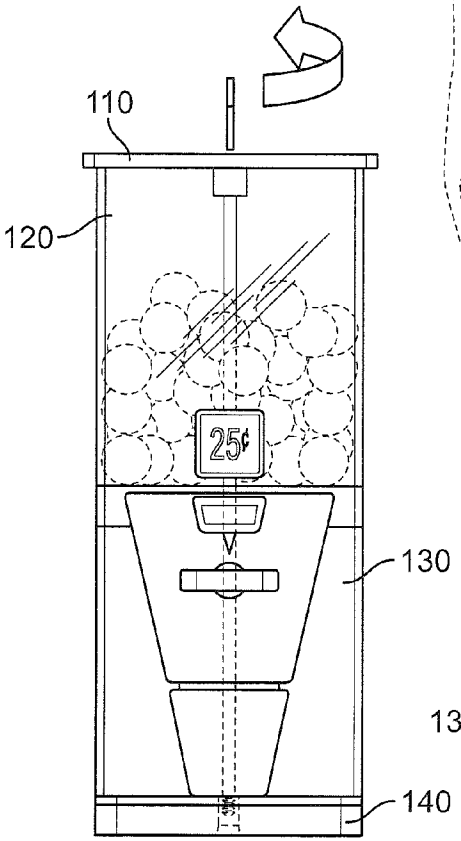
Figure 11:
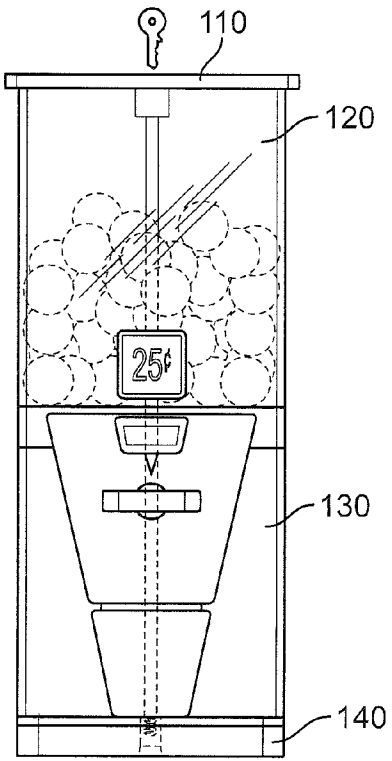
Figure 14:
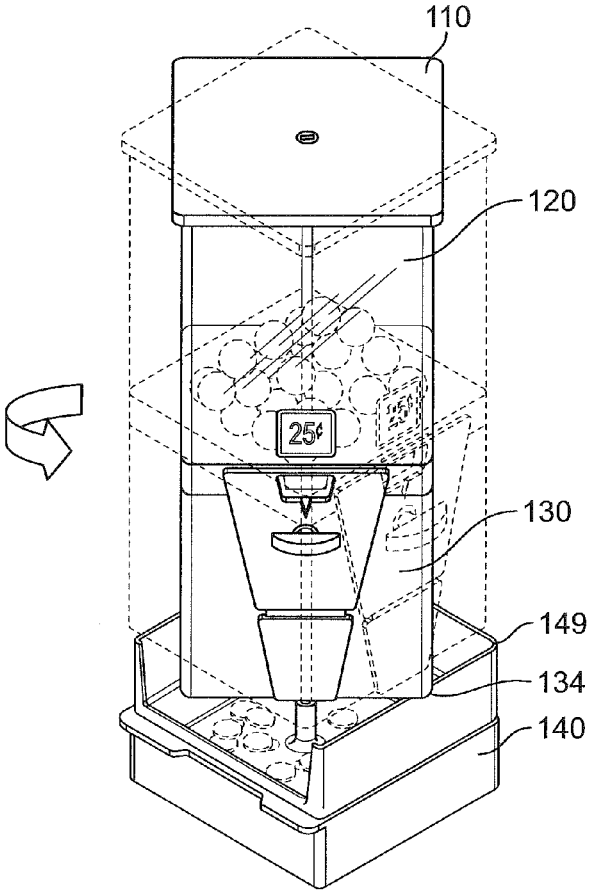
Figure 15:
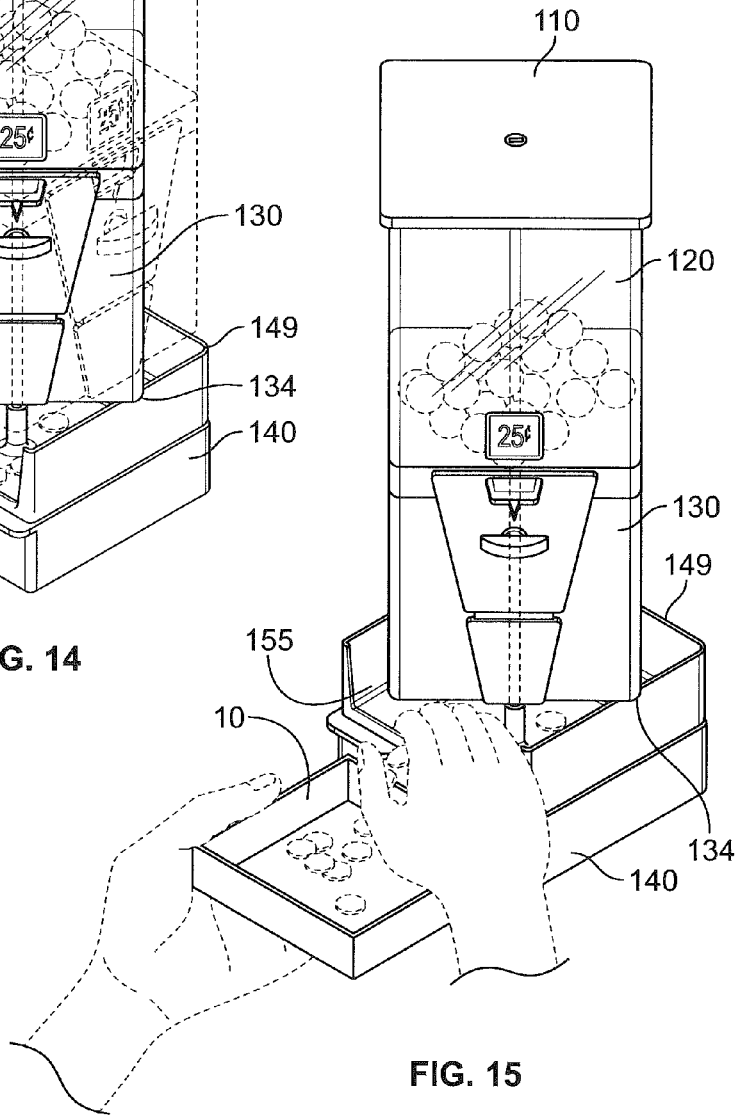

Once retro-fitted, the owner has an much easier time in removing coins from the improved coin-operated vending machine. Referring now to FIGS. 11-15, the owner would unlock the unit with a key and partially unscrew the center rod 115. The owner could then left the entire top portion of the unit away from the improved base unit 140 until the bottom terminal edge 134 is higher then the uppermost portion 149 of the second walled section 148. The owner would then rotate the unit such that the terminal edge 134 of the body is capable of rest on the uppermost portion 149 of the second walled section 148. The owner is then capable of user their hand to scoop out the coins from the opened portion 155 in the second walled section 148.

From the foregoing and as mentioned above, it will be observed that numerous variations and modifications may be effected without departing from the spirit and scope of the claims and novel concept of the invention. It is to be understood that no limitation with respect to the specific methods and apparatus illustrated herein is intended or should be inferred.

We claim:

1. A method of retro-fitting a coin-operated vending machine, where the coin-operated vending machine has a cap, a globe, a hopper attached to the globe, a body aligned with the hopper, a coin retainer plate securely attached to the body, a base and a center rod passing through the globe, hopper, body, and coin retainer plate, the coin retainer plate being defined to prevent inserted coins from falling onto the base and requiring the flipping of the vending machine over to retrieve inserted coins from the body, and the center rod having threaded ends to secure the cap to the base, the method comprising:

removing the base and coin retainer plate; and connecting an improved base unit to a lower end of the center rod, said improved base unit comprising a bottom for collecting coins and an opened section for access to the bottom, wherein when the improved base unit is connected to the center rod, the body is movable relative to the improved base unit into at least two configurations, a first configuration defined such that the opened section is hidden within the body preventing access to the bottom, and a second configuration defined such that at least a portion of the opened section is exposed whereby access to the bottom, and any coins, is granted through the exposed opened section.

2. The method of claim 1, wherein the improved base unit is further defined to include:

a lower base section having a first walled section surrounding a periphery of the lower base section;

a center portion being positioned in the lower base section and having a female threaded receiving section configured to receive the lower end of the center rod; and a second walled section extending upwardly from the first walled section and being positioned inwardly from the first walled section to define a rim along a junction of the first walled section and the second walled section, wherein the opened section is positioned in the second walled section.

3. A coin-operated vending machine, where the coin-operated vending machine has a cap, a globe, a hopper attached to the globe, a body aligned with the hopper, a coin retainer plate securely attached to the body, a base positioned below the body, and wherein the coin retainer plate being defined to prevent inserted coins from falling onto the base and further defined to require the vending machine to be flipped over to retrieve inserted coins from the body, and the vending machine further having a center rod passing through the globe, hopper, body, and coin retainer plate, and the center rod having an upper end secured to the cap and a lower end secured to the base, improvement comprising:

an improved base unit secured to a lower end of the center rod, said improved base unit comprising a bottom for collecting coins and an opened section for access to the bottom, wherein when the improved base unit is connected to the center rod, the body is movable relative to the improved base unit into at least two configurations, a first configuration defined such that the opened section is hidden within the body preventing access to the bottom, and a second configuration defined such that at least a portion of the opened section is exposed whereby access to the bottom, and any coins, is granted through the exposed opened section.

4. The apparatus of claim 3, wherein the improved base unit is further defined to include:

a lower base section having a first walled section surrounding a periphery of the lower base section;

a center portion being positioned in the lower base section and having a female threaded receiving section configured to receive a lower end of the center rod; and a second walled section extending upwardly from the first walled section and being positioned inwardly from the first walled section to define a rim along a junction of the first walled section and the second walled section, wherein the opened section is positioned in the second walled section.

* * * * *